US006454329B1

(12) United States Patent
Collins, Jr.

(10) Patent No.: US 6,454,329 B1
(45) Date of Patent: Sep. 24, 2002

(54) DEVICE FOR REMOVING LEAVES AND OTHER DEBRIS FROM AN OVERHEAD GUTTER

(76) Inventor: Harry F. Collins, Jr., 1359 Shawnee Trail, Troutville, VA (US) 24175-6902

( * ) Notice: Subject to any disclaimer, the term of this patent is extended or adjusted under 35 U.S.C. 154(b) by 0 days.

(21) Appl. No.: 09/878,999

(22) Filed: Jun. 13, 2001

(51) Int. Cl.[7] ..... E04D 13/076
(52) U.S. Cl. ..... 294/19.1; 15/236.04
(58) Field of Search ..... 294/19.1, 22, 23; 15/236.04; 56/329, 332, 333, 334, 337

(56) References Cited

U.S. PATENT DOCUMENTS

| | | | | | |
|---|---|---|---|---|---|
| 296,514 | A | * | 4/1884 | Bottomley | 30/188 |
| 2,581,236 | A | * | 1/1952 | Cardinale | 56/334 |
| 2,896,239 | A | * | 7/1959 | Bugbird | 15/144.1 |
| 3,387,444 | A | * | 6/1968 | Krdzic | 56/334 |
| 3,668,848 | A | * | 6/1972 | Gerkin | 56/334 |
| 3,743,339 | A | * | 7/1973 | Brackett | 15/236.04 |
| 3,972,552 | A | | 8/1976 | Earp, Jr. | |
| 4,057,276 | A | | 11/1977 | Currie | |
| 4,114,938 | A | | 9/1978 | Strader | |
| 4,194,780 | A | | 3/1980 | Dilley | |
| 4,319,851 | A | * | 3/1982 | Arthur | 134/167 C |
| 4,447,927 | A | | 5/1984 | Malless, Jr. | |
| 4,502,806 | A | | 3/1985 | Albertson | |
| 4,930,824 | A | | 6/1990 | Matthews et al. | |
| 5,853,209 | A | * | 12/1998 | McDermott | 15/236.04 |
| 5,855,402 | A | | 1/1999 | Maraschiello | |
| 6,017,070 | A | | 1/2000 | Poppa | |
| 6,139,077 | A | * | 10/2000 | Molzan, II | 15/236.04 |

FOREIGN PATENT DOCUMENTS

| | | | | |
|---|---|---|---|---|
| WO | WO 84/02553 | * | 7/1984 | 294/19.1 |

* cited by examiner

*Primary Examiner*—Dean J. Kramer
(74) *Attorney, Agent, or Firm*—Dinesh Agarwal, P.C.

(57) ABSTRACT

A device for removing debris from an overhead gutter, includes an elongated pole with proximal and distal end portions. A debris handling assembly is disposed adjacent the distal end portion of the pole. A resting member for balancing the device on a gutter is provided. A debris collection member is disposed adjacent the distal end portion of the pole.

17 Claims, 3 Drawing Sheets

75
28
32
24
G
73
10
GCD
56
P
GD
18
28
20
30
26
24
14
32
10
12
62
16

FIG. 6
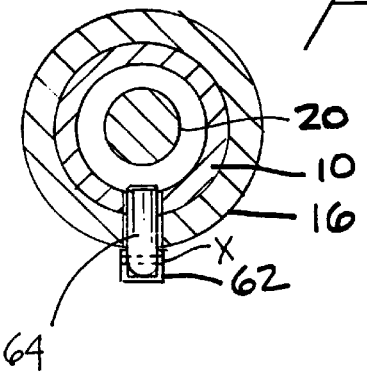
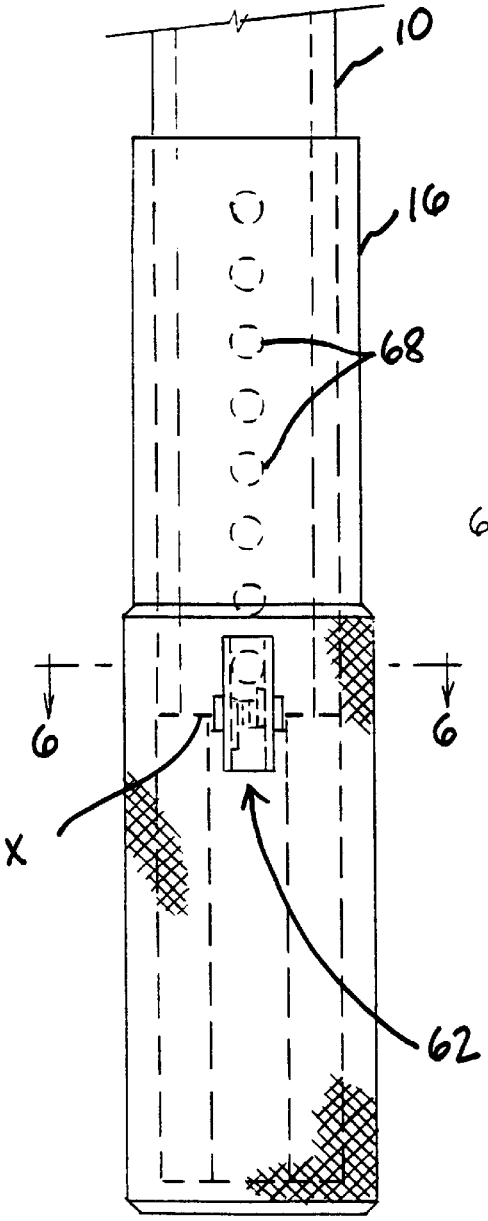
FIG. 5
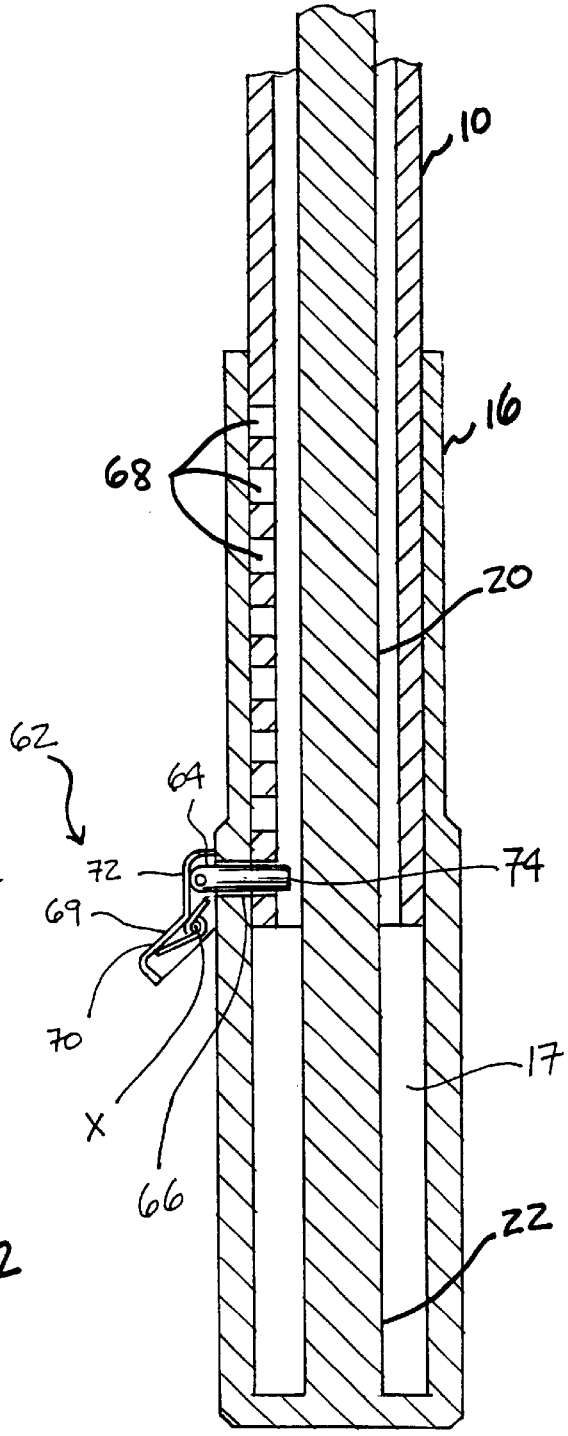
FIG. 7

DEVICE FOR REMOVING LEAVES AND OTHER DEBRIS FROM AN OVERHEAD GUTTER

FIELD AND HISTORICAL BACKGROUND OF THE INVENTION

The present invention is directed to cleaning devices, and more particularly to a device for removing leaves, pine needles, dirt, roof granules, and other debris from an overhead gutter of a residential or commercial building, or the like.

In early spring, it is a familiar and common sight showing building owners, particularly homeowners, engage in cleaning gutters. This is because in autumn or the fall season, trees, shrubs, etc, shed leaves, pine needles and the like that tend to accumulate in the gutters. Other debris also tends to gravitate toward and gets accumulated in the gutters.

Gutters are used on homes and buildings to properly channel the flow of water from a roof to the ground. Failure to keep gutters free of leaves and debris results in improper flow of water from the roof to the ground. This may cause damage to the roof, the gutter, the eaves, or even the inside of a home where water may be channeled.

The history of cleaning gutters has seen many tools developed to aid in this undesirable task. However, the most common and ordinary means has been to clean gutters by climbing a ladder. This has been accomplished by two methods. The first method is to climb onto the roof and physically clean the debris by hand or a small hand-held device. This method is very dangerous as the person has to lean over the edge of the gutter, while on a slopped roof also leaning towards the ground. The second method is by climbing up and down and manually moving the ladder laterally. This is also very dangerous because of the climbing itself and the possibility of the ladder moving while an individual is on it.

Other tools have been developed to remotely clean gutters. However, none of them have the safety features of the present invention, nor the ability to discard the leaves or debris in a controlled manner. Although the prior devices may be used from the ground, they require holding the apparatus, which is strictly the job of the person cleaning the gutter, with no weight-shifting or safety features. Conventional devices also do not have any guards or supports to hold the device in place. This means if it tilts too far in one direction, the device could fall to the ground or into the house. Even further, there are no controlled means to collect the leaves or debris, except letting it fall to the ground or lowering the device to the ground every time the device is full. Devices have also been proposed that use a water hose to flush the gutter clean. However, the debris flies out of the gutter and the person has no control over where it may go.

Various gutter cleaning devices have been proposed in the art, and examples are illustrated in U.S. Pat. Nos. 3,972,552; 4,057,276; 4,114,938; 4,194,780; 4,447,927; 4,502,806; 4,930,824; 5,855,402; and 6,017,070.

The prior art devices allow a person to clean an overhead gutter while staying at the ground level. In order to clean a gutter, a person holds a long handle to reach an overhead gutter and manipulates it to remove debris from the gutter. Although conventional devices allow a person to clean a gutter without having to climb a ladder, they still are not fully satisfactory in that effective debris collection means and safety features are not provided.

Therefore, there is a need in the industry for a remote gutter cleaning device where a person may thoroughly remove leaves and other debris in a safe and clean manner without being exposed to the risks of climbing or having to pick the debris up again from the ground.

OBJECTS AND SUMMARY OF THE INVENTION

The principal object of the present invention is to provide a device for removing leaves and other debris from an overhead gutter which overcomes the drawbacks associated with conventional devices.

One object of the present invention is to provide a safe and clean device for removing leaves and other debris from an overhead gutter which collects leaves and debris from a gutter and maintains control of the leaves and debris until it is disposed of in an intended bag or container. The device of the present invention includes an elongated pole having one end adaptable for an extension, for a multiple story dwelling, and a remote end with a mechanism designed to interact to collect and grasp leaves and other debris by spring-loaded fingers actuated by a rope or cord which will rise above the gutter, rotate, and dispose of the leaves and debris into an attached bag or container.

Another object of the present invention is to provide a device for removing leaves and other debris from an overhead gutter which allows a person to accumulate the leaves and debris adjacent the gutter thereby eliminating the need for the person to repeatedly remove the leaves and debris portion-by-portion from the gutter and collecting at the ground level. In other words, the device of the present invention allows a person to accumulate the leaves and debris adjacent the gutter, instead of having to bring it down on the ground in each instance of removing a small portion thereof. Therefore, the device of the invention allows a person to remove and accumulate the leaves and other debris, as the person moves along the gutter. This results in a faster, safer, and more efficient cleaning of the gutter.

An additional object of the present invention is to provide a device for removing leaves and other debris from an overhead gutter in which the leaves and debris are collected adjacent the gutter thereby providing for a cleaner and more time-efficient operation.

A further object of the present invention is to provide a device for removing leaves and other debris from an overhead gutter which includes a resting member that allows a person to balance or suspend the device from a gutter, thereby alleviating fatigue of the arms and shoulders due to maneuvering a long device overhead for an extended period. The resting member further allows a person to concentrate on cleaning the gutter, instead of struggling or maneuvering to hold the device, particularly on multiple story buildings. This results in the safety of the person and security of the building.

In summary, the main object of the present invention is to provide a device for removing leaves and other debris from an overhead gutter which allows a person to remove and collect the debris adjacent the gutter for a more cleaner and efficient operation, and which allows a person to balance or suspend the device from a gutter to alleviate fatigue.

In accordance with the present invention, a device for removing debris from an overhead gutter, includes an elongated pole with proximal and distal end portions. A debris handling assembly is disposed adjacent the distal end portion of the pole. A resting member for balancing the device on a gutter is provided. A debris collection member is disposed adjacent the distal end portion of the pole.

BRIEF DESCRIPTION OF THE DRAWINGS

The above and other objects, novel features and advantages of the present invention will become apparent from the following detailed description of the invention, as illustrated in the drawings, in which:

FIG. 5 is an enlarged view of the bottom portion of the device shown in FIG. 2;

FIG. 6 is a cross-sectional view taken along lines 6—6 of FIG. 5; and FIG. 7 is a longitudinal sectional view of FIG. 5.

DETAILED DESCRIPTION OF THE INVENTION

Figures 1, 2:
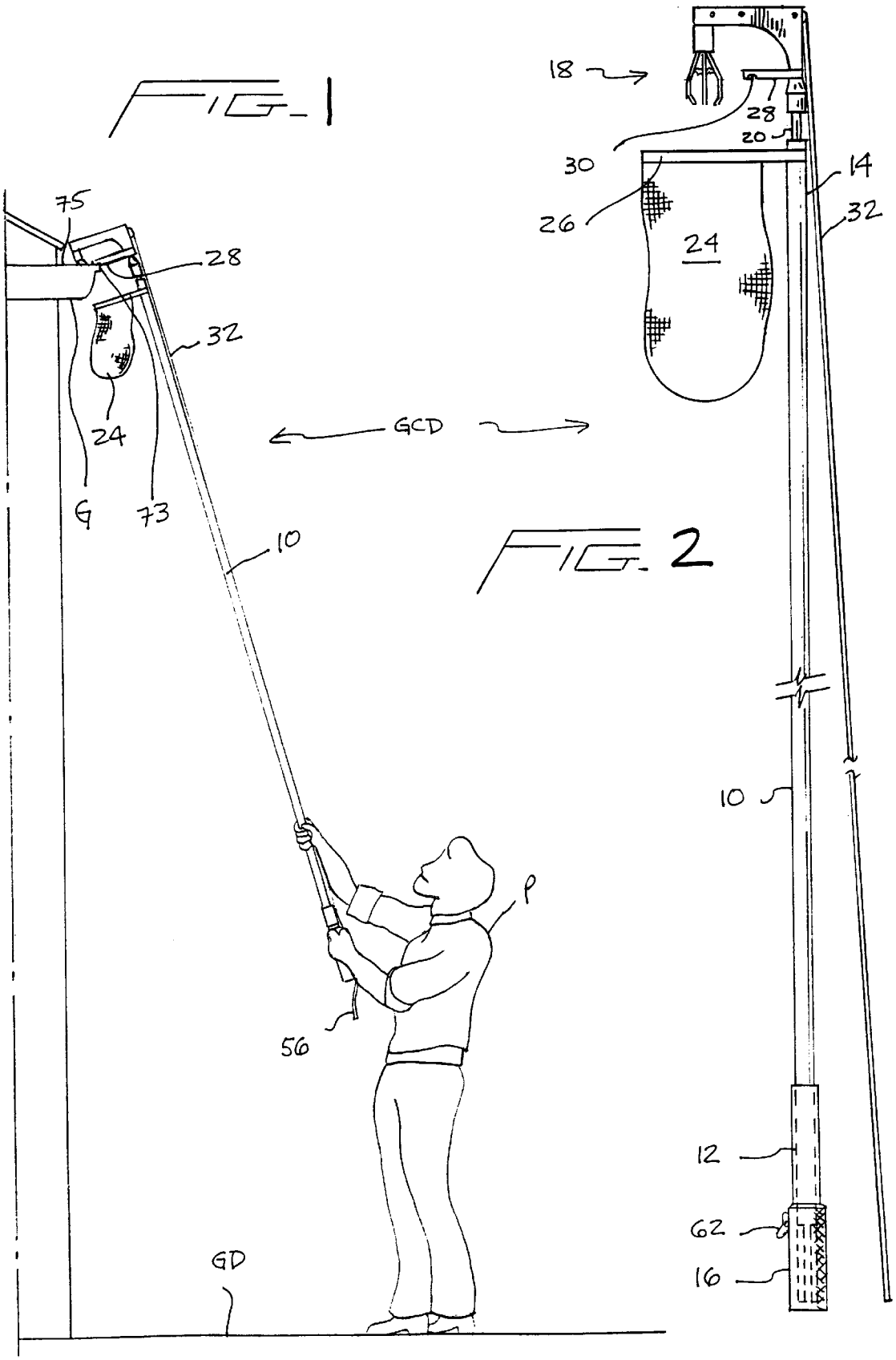
FIG. 1 is side elevational view of the device of the present invention, shown in use by a person.
FIG. 2 is an enlarged side elevational view of the device shown in FIG. 1.

As best shown in FIG. 2, the gutter cleaning device GCD of the present invention, includes an elongated pole 10 with proximal and distal end portions 12 and 14, respectively. The pole 10 is constructed and designed to be controlled and operated by a person from a remote locate, i.e., the ground GD, below a gutter G, and is made of a suitable aluminum, plastic or the like light-weight material that is not a conductor of electricity. Preferably, the pole 10 has a length of about 6–8 feet, however, this could be varied to lengths that allow it to reach multiple story buildings or dwellings.

The proximal end portion 12 of the pole 10 is telescopically received in a handle 16. A leaf or debris handling assembly 18 is disposed adjacent the distal end portion 14, and includes an elongated rod 20 extending through the pole 10 and having the end 22 thereof connected to handle 16 (FIG. 7). It would be appreciated that since the debris handling assembly 18 is connected to the handle 16 by the rod 20, the assembly 18 can be actuated, i.e., moved up or down, or rotated, relative to the pole. In this regard, it is noted that the length of the handle 16, and thus the length of its interior recess 17, may be varied to enlarge the range of relative axial movement between the pole 10 and the handle 16.

As best shown in FIGS. 1–4, a debris collection container 24, preferably a trash disposal bag or liner, is mounted to the distal end portion 14 by a suitable support bracket 26. A resting bar 28 extends substantially horizontally from the debris handling assembly 18, and includes a generally C-shaped cut-out portion 30, to be set upon the outside edge of the gutter G to suspend or balance the gutter cleaning GCD thereon, to alleviate the weight of the device from the person P at a remote location on the ground GD. The resting bar 28 also functions to provide additional support for the gutter cleaning device GCD to minimize imbalance or accidental fall thereof. This is particularly important when actuating the flexible rope or cord 32 to maneuver the debris handling assembly 18, as described below. Although, not shown, a set-screw or the like may be associated with the resting bar 28 to adjust its position vertically.

Figure 4:
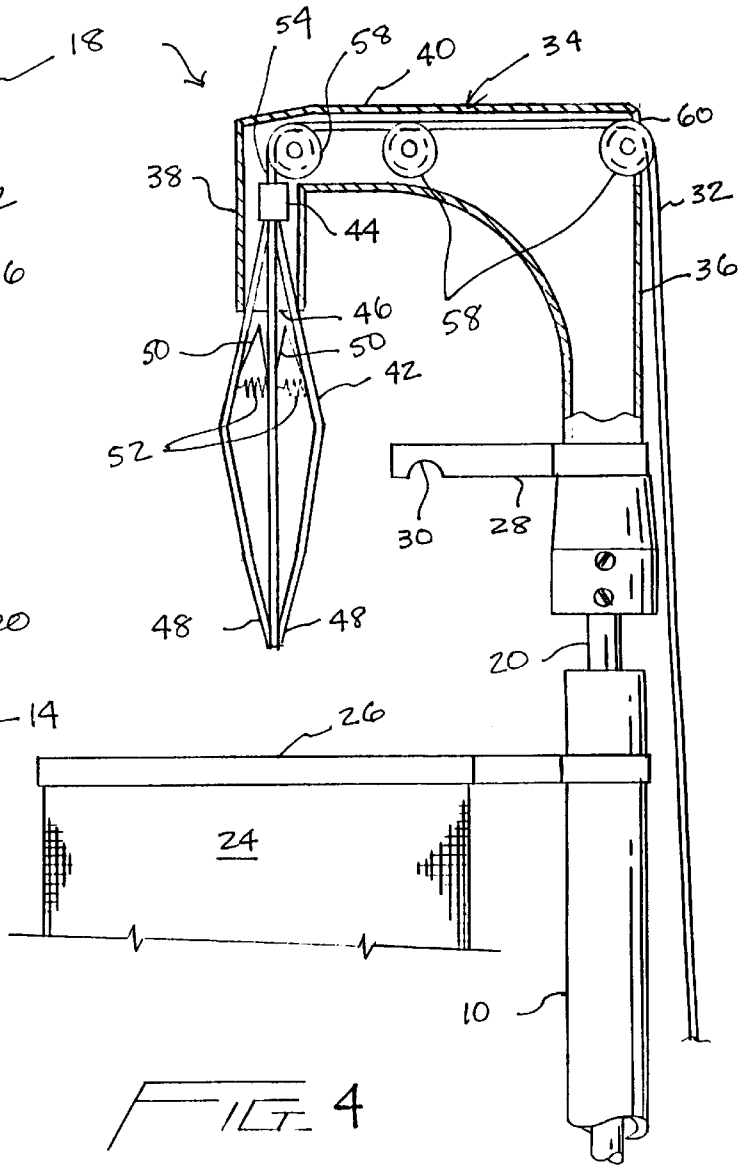
FIG. 4 is a view similar to FIG. 3, showing the debris collection fingers in a closed position.
Figure 3:
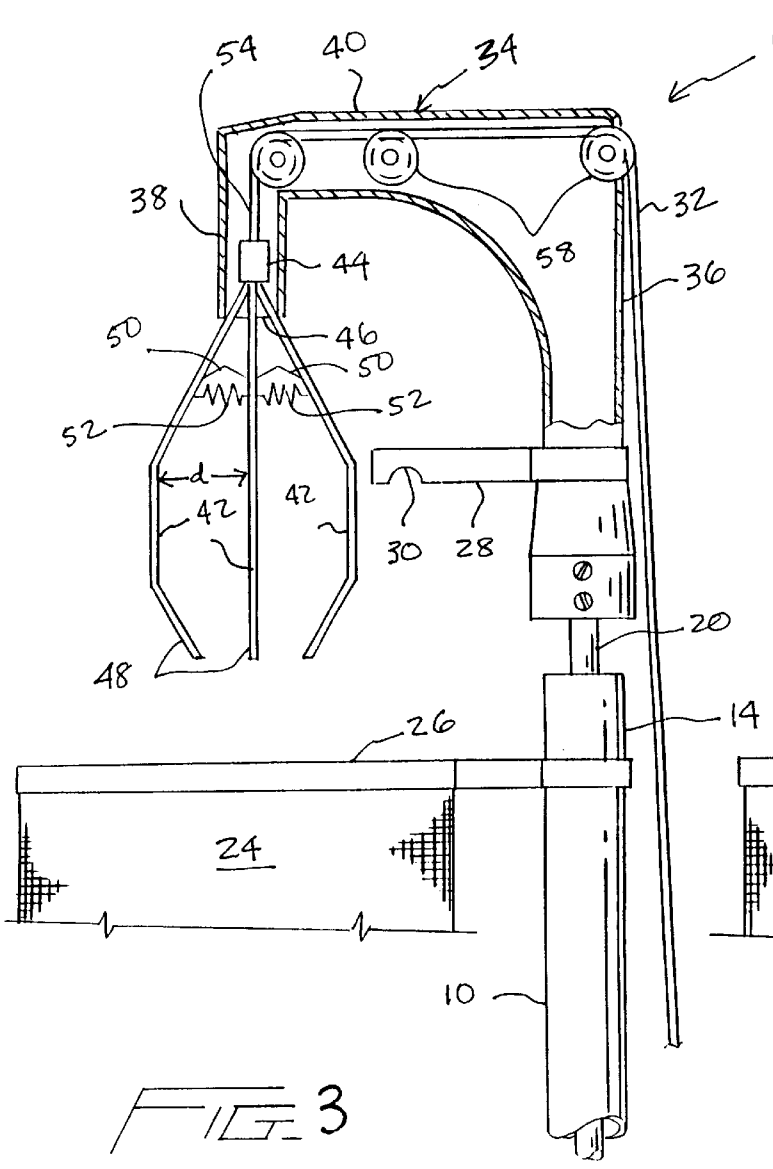
FIG. 3 is an enlarged, partially in section, top portion of the device of FIG. 2, showing the debris collection fingers in an open position.

As best shown in FIGS. 3–4, the debris handling assembly 18 is a generally inverted L-shaped housing 34, preferably made of aluminum, plastic or the like light-weight material that is not a conductor of electricity. The housing 34 includes a main section 36 extending generally axially relative to pole 10, a tubular downwardly extending guide section 38, and an intermediate section 40. As can be seen in FIGS. 3–4, the main section 36 and the guide section 38 extend generally parallel to one another, and the intermediate section 40 extends substantially horizontally therebetween.

Preferably, three debris handling fingers 42 that are connected at a point 44, extend downwardly through the opening 46 of the guide section 38. The fingers 42 have free end portions 48 that open (diverge) and close (converge), shown in FIGS. 3 and 4, respectively. The fingers 42 are interconnected by elbow braces 50 that stretch or flex as the fingers open or close. In addition to providing a smooth, controlled, and synchronized opening and closing of the fingers 42, the elbow braces 50 limit the outward opening of the fingers 42 to a desired degree. This is important in that the maximum distance 'd' between two fingers 42, or the linear length of an area covered by the fingers 42 in the open position, be less than the width of a gutter opening in order to allow the fingers 42 to be lowered into the gutter G to pick-up the debris therefrom. Although not shown, braces 50 may include a mechanism to adjust their lengths in the fully extended position.

Although it is preferable that fingers 42 be made of a rigid, yet flexible metal or plastic material for the ease of opening or closing thereof, conventional springs 52 are biased between the fingers 42 to facilitate their opening.

As best shown in FIGS. 3–4, the distal end 54 of the rope 32 is connected to the connection point 44, but the proximal end 56 thereof remains free adjacent handle 16 (FIG. 1) to be actuated by the person P. The rope 32 is guided over a series of pulleys 58 and extends out from the side opening 60 in the main section 36.

As best shown in FIGS. 5–7, in order to selectively interlock pole 10 relative to handle 16, a spring-biased lock assembly 62 is provided on the handle 16 which pivots about a horizontal axis X. The lock assembly 62 includes a spring-loaded lever 69, and a pin 64 that extends through a hole 66 in the handle 16, to be received in one of the corresponding holes 68 in the pole 10. When the lower portion 70 of lever 69 is pushed downwardly (to the right in FIG. 7), the upper portion 72 thereof would swing away from the handle 16 (to the left in FIG. 7) thereby causing the pin 64 to move out from hole 68 and unlocking the handle 16 from the pole 10.

USE AND OPERATION

Prior to using the gutter cleaning device GCD of the invention, the user P would adjust the position of the debris handling assembly 18 relative to the support bracket 26, such that there is sufficient clearance for the gutter G to be positioned therebetween. This is easily done by unlocking the lock assembly 62 and moving the handle 16 up relative to the pole 10 and locking by allowing the pin 64 to be selectively received in one of the holes 68 in the pole 10, as described above. Although not necessary, it is preferable that the debris collection bag 24 be positioned either to the left or to the right of the debris handling assembly 18, instead of directly below it, for the ease of removing and releasing the debris into the bag 24.

In use, a person P would hold up the gutter cleaning device GCD in a manner that the debris handling assembly 18 is positioned over the gutter G, and maneuver the device such that the cut-out portion 30 of the resting bar 28 engages the outer edge 73 of the gutter G (FIG. 1). In this position, the free end portions 48 of the fingers 42 would be adjacent the inside bottom of the gutter G and, when the user P pulls the proximal end 56 of the rope 32 downwardly, the fingers 42 would close and move upwardly away from the gutter G, thereby grasping leaves or debris from inside the gutter G. Once the free end portions 48 of the fingers 42 clear the top 75 of the gutter G, the user would unlock the lock assembly 62 and rotate the handle 16, while holding the pole 10 steady, to rotate and align the debris handling assembly 18 over the collection bag 24. By relieving the tension on the rope 32, the fingers 42 would drop down and open to their outermost position, due to the forces exerted by springs 52, thereby allowing the leaves and other debris to be released into the bag 24. The user P would then rotate the debris handling assembly 18 back to the initial position by rotating the handle 16 and repeat the same procedure.

It is noted herewith that when the handle 16 is rotated back-and-forth, the inner end 74 of the pin 64 would ride on the periphery of the pole 10 and, since the lock assembly 62 is spring-loaded, a slight force would be exerted on the pole 10 which would prevent a free rotation of the handle 16. This arrangement would facilitate the user P in obtaining a precise and positive alignment of the debris handling assembly 18 over the gutter G or bag 24.

While this invention has been described as having preferred ranges, steps, materials, or designs, it is understood that it is capable of further modifications, uses and/or adaptations of the invention following in general the principle of the invention, and including such departures from the present disclosure, as those come within the known or customary practice in the art to which the invention pertains and as may be applied to the central features hereinbefore set forth, and fall within the scope of the invention and of the appended claims. It is further understood that the present invention is not limited to the claims appended hereto.

What is claimed is:

1. A device for removing debris from an overhead gutter, comprising:

a) an elongated pole including proximal and distal end portions;

b) a debris handling assembly disposed adjacent the distal end portion of said pole;

c) a resting member for balancing the device on a gutter;

d) a debris collection member disposed adjacent the distal end portion of said pole;

e) said debris handling assembly comprising a housing including first and second portions separated by a third intermediate portion; and f) a plurality of fingers disposed adjacent the first portion of said debris handling assembly.

2. The device of claim 1, wherein:

said resting member includes an arm extending generally at a right angle to said pole.

3. The device of claim 1, wherein:

said resting member includes a recessed portion for receiving a portion of the gutter.

4. The device of claim 3, wherein:

said recessed portion comprises a cut-out portion.

5. The device of claim 1, further comprising:

a resilient member disposed between said fingers.

6. The device of claim 5, wherein:

said fingers are interconnected by a brace member.

7. The device of Claim 5, wherein:

said fingers include first and second end portions; and the first end portions of said fingers are free and the second end portions thereof are connected about a mounting point.

8. The device of claim 7, wherein:

the first portion of said debris handling assembly comprises a generally tubular member having an opening; and said mounting point is disposed inside said tubular member.

9. The device of claim 8, wherein:

said fingers extend outwardly through said opening;

said mounting point is movable relative to said tubular member; and said fingers open or close as said mounting point moves relative to said tubular member.

10. The device of claim 9, further comprising:

means for moving said mounting point including an actuator positioned adjacent the proximal end portion of said pole.

11. The device of claim 10, wherein:

said mounting point moving means comprises an elongated member having a first end connected to said mounting point and a second free end disposed adjacent the proximal end portion of said pole.

12. The device of claim 1, wherein:

said debris handling assembly is axially extendible from said pole.

13. The device of claim 12, further comprising:

a handle disposed adjacent the proximal end portion of said pole; and said handle is rotatable relative to said pole.

14. The device of claim 13, further comprising:

means for interlocking said handle and said pole.

15. The device of claim 13, further comprising:

an elongated member connecting said handle with said debris handling assembly.

16. The device of claim 15, wherein:

said elongated member extends through said pole.

17. A device for removing debris from an overhead gutter, comprising:

a) an elongated pole including proximal and distal end portions;

b) a debris handling assembly disposed adjacent the distal end portion of said pole;

c) a handle disposed adjacent the proximal end of said pole;

d) said debris handling assembly including a shaft extending through said pole and connected to said handle;

e) a resting member for balancing the device on a gutter;

f) a debris collection member disposed adjacent the distal end portion of said pole;

g) said resting member including a recessed portion for receiving a portion of the gutter;

h) said handle and said pole being telescopically arranged relative to each other; and i) means for interlocking said handle and said pole.

* * * * *